United States Patent [19]

Swartz

[11] Patent Number: 5,028,796

[45] Date of Patent: Jul. 2, 1991

[54] SUPPORT BELT FOR RADIATION SHIELD GARMENT

[76] Inventor: Dennis F. Swartz, P.O. Box 1388, Haverhill, Mass. 01831

[21] Appl. No.: 533,503

[22] Filed: Jun. 5, 1990

[51] Int. Cl.[5] ..... G21F 3/02; A41D 13/00

[52] U.S. Cl. ..... 250/516.1; 2/2; 2/48

[58] Field of Search ..... 250/516.1; 2/2, 48, 2/51

[56] References Cited

U.S. PATENT DOCUMENTS 4,527,288 7/1985 Hoffman et al. ..... 2/48
4,766,608 8/1988 Cusick et al. ..... 2/2
4,843,641 7/1989 Cusick et al. ..... 2/48
4,891,846 1/1990 Sager et al. ..... 2/2

*Primary Examiner*—Bruce C. Anderson
*Attorney, Agent, or Firm*—Herbert L. Bello

[57] ABSTRACT

An improved support belt for radiation shield garments has a padded, slip-resistant rear support element, one or more elasticized elements, one or more connecting elements, and adjustable fastening means for securing the ends of the belt to one another. The padded, slip-resistant rear support element comprises a relatively thin, flexible foam core that is covered with a foam-backed vinyl, the foam facing outwardly for frictionally engaging and supporting the radiation shield garment at the waist of a user.

16 Claims, 1 Drawing Sheet

SUPPORT BELT FOR RADIATION SHIELD GARMENT

BACKGROUND OF THE INVENTION

It is well-known in the art to provide protective garments tO personnel working in or near a radioactive environment, for example, to health care workers operating x-ray equipment or working in radiology laboratories. Generally, such radiation shield garments are extremely heavy because they include one or more layers of lead sheet material to provide the desired protection.

Prior art protective garments were designed and worn in such a way that most of the weight of the garment was supported by the wearer's shoulders and upper back leading to discomfort and excessive fatigue. One example of such a garment is shown in U.S. Pat. No. 4,441,025 to McCoy. This disadvantage of prior art protective garments led to efforts to shift the weight load to other parts of the wearer's body. Based on the technology of backpacks for hikers, which are designed to shift at least a portion of the weight to the user's waist and hips, Cusick et al. developed the idea for an elasticized support belt to be used in conjunction with protective garments, as described in U.S. Pat. No. 4,766,608. The aforementioned patents and the references cited therein are incorporated herein by reference.

As shown in FIGS. 1–5 of the Cusick et al. patent, the support belt is an integral part of and permanently attached to the protective garment (col.3, lines 37–39). Similarly, as shown in FIGS. 6–8, the Cusick et al. support belt is integral with the protective garment (col.4, lines 48–50). As shown in FIGS. 9 and 10, however, the Cusick et al. support belt is detachably attached to the protective garment by snap buttons or, alternatively, "can be fixed to the garment by velcro, rivets, stitching etc." (col. 5, lines 13–17). The patent further teaches that: "Indeed, the belt need not be attached to the garment at all, but only fixed to itself when worn around the waist of the garment," (col. 5, lines 18–21).

But, the Cusick et al. patent does not teach how a separate, independent support belt that is not in some way attached to the protective garment during use could supply the necessary support to significantly reduce the weight load carried on the user's shoulders and upper back. It must be kept in mind that the function of the belt in Cusick et al. is not just to close the front of the garment and gather it about the waist, but rather to effectively shift a significant share of the weight of the garment to the wearer's waist and hips. As shown and described in Cusick et al., this weight shifting occurs because, when the belt is fastened around the user's waist substantially all of the weight of the garment below the user's waist is supported by the user's hips, and a substantial proportion of the weight of the garment above the waist is also supported by the user's hips. This support occurs, according to Cusick et al., precisely because of "the action of the belt in holding the garment firmly against the body" (col. 2, lines 19–24).

In other words, it is at the point of physical attachment between the belt and the garment that the bulk of the garment's weight is transferred from the user's shoulders to his waist. If the belt in the Cusick et al. invention is not physically attached in some way to the garment while in use, the garment would have a tendency by action of gravity to slide downward, slipping underneath the belt, until the bulk of the garment's weight was again being carried on the user's shoulders and back. Even if the belt of the Cusick et al. invention were tightened to the point of extreme user discomfort, there would still be a tendency for slippage with every user movement, especially during bending movements.

Accordingly, Cusick et al. does not teach any way to actually carry out the concept of a separate, independent support belt that does not need to be physically attached to the protective garment while in use. Furthermore, the elasticized belt described in Cusick et al. can be uncomfortable and unduly restrictive in use. The need to attach the belt to the garment requires attachment means on both the belt and the garment which increases manufacturing costs and prevents interchangeable use of the belt with other protective garments. The need for attachment means also increases the time required to put on and remove the support belt. These and other drawbacks of the prior art are overcome with the present invention.

OBJECTIVES OF THE INVENTION

It is a principal object of this invention to provide a support belt for radiation shield garments that is completely independent of said garments.

It is also an object of this invention to provide a support belt for radiation shield garments that shifts a substantial portion of the garment's weight from the user's shoulders and upper back to his waist and hips without any physical attachment between the support belt and the garment.

A further object of this invention is to provide a support belt that can be used interchangeably with a variety of radiation shield garments without special adaptation.

Still another object of this invention is to provide a comfortable, light-weight and less restrictive support belt that can quickly be put on and removed.

These and other objects and advantages of this invention will be apparent from the following description.

DETAILED DESCRIPTION OF THE INVENTION

Figure 1:
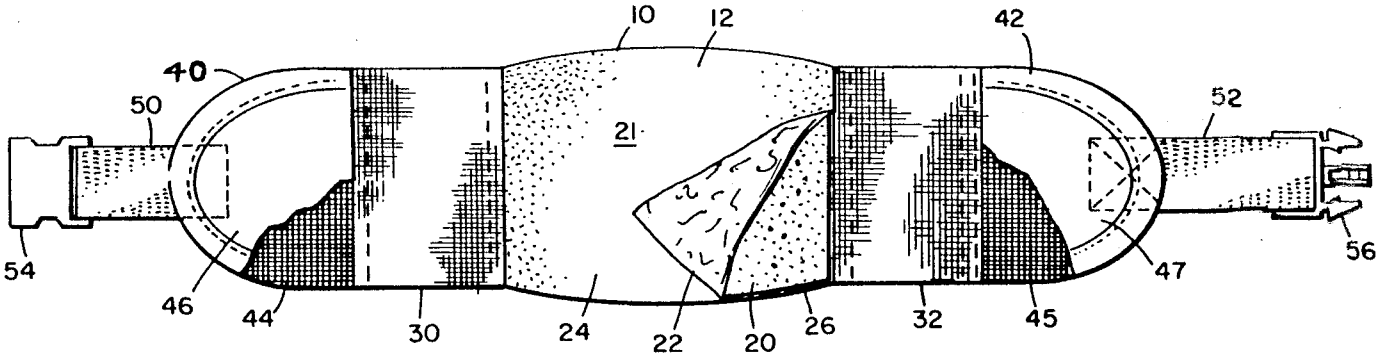
FIG. 1 is a schematic, partial cut-away view of the support belt of this invention.

FIG. 1 is a schematic view of the inner face of a support belt constructed in accordance with this invention. Portions of the belt as shown are depicted in partial cut-away or peeled-back configuration to reveal the internal structure. Support belt 10 as shown in FIG. 1 includes an elongated rear support element 12 attached at either end thereof to elasticized elements 30 and 32. The elasticized elements 30 and 32 are in turn attached to connecting elements 40 and 42, respectively which, in turn, are attached to adjustable fastening means consisting of straps 50 and 52 and mating plastic buckle means 54 and 56. At lease one of said mating buckles includes conventional means for adjusting the length of the adjoining straps, for example, loop and catch means (not shown).

Figure 3:
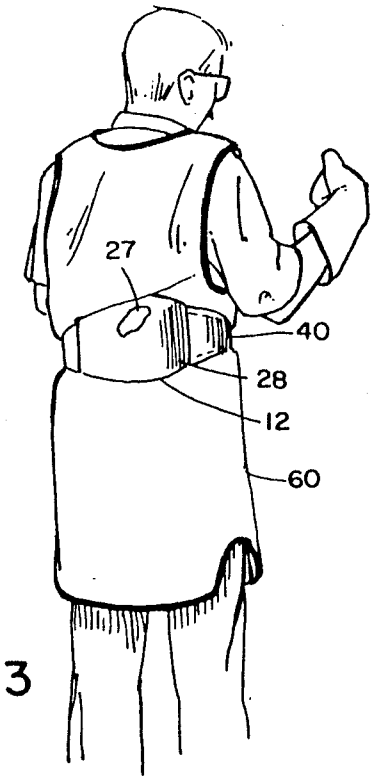
FIG. 3 is a schematic rear view of an individual wearing a radiation shield garment and the support belt of this invention.

The elongated rear support element 12 comprises a light-weight relatively thin (e.g. about ⅛–½ inch), relatively firm but flexible core 20. The function of the core 20 is to provide padding as well as structural support for the rear support element. At the same time, the core 20 must be flexible enough to repeatedly bend to conform to the contour of the wearer's back while in use as shown in FIG. 3. Various types of foam, rubber and similar materials will work well as the material for core 20. Layers of woven fabric (natural, synthetic or composites) and an enclosed pouch filled with a light-weight natural or synthetic fill can also be used as core 20 if they have the appropriate balance between stiffness and flexibility. Volara foam is a preferred embodiment for core 20. Selection of an appropriate material and thickness for core 20 is a matter of routine experimentation.

The inner face of core 20 is covered with a slip-resistant material that frictionally engages the exterior surface of the radiation shield garment in order to retard slippage while the support belt is in use. In general, radiation shield garments have an exterior surface made of tightly woven synthetic fabric. A variety of soft, light-weight foam and rubber materials are known to frictionally engage a surface of woven synthetic fabric without scratching or damaging that surface.

In the preferred embodiment of this invention, the inner face of core 20 is covered with a flexible foam-backed vinyl material 21 consisting of a vinyl inner face 22 and a thin foam-layer outer face 24. Foam-backed vinyl fabrics are well known in the art. By bonding a thin delicate and easily damaged foam or rubber sheet to a vinyl support layer, a flexible yet durable composite sheet is created. Such composites are ideally suited to covering the inner face of core 20 in this invention. The foam or rubber side of such composites should be outwardly facing in order to serve as the frictionally-engaging material for contacting the exterior surface of the radiation shield garment.

The outer face 27 of core 20 (not shown) is covered with a thin, woven synthetic fabric such as 200 denier fabric as shown at item 28 in FIG. 3. The purpose of covering 28 is simply to enclose and protect core 20 and to present a smooth, durable and attractive outer face. Any suitable covering material could be used for this purpose.

The overall dimensions and shape of rear support element 12 are not critical and may be adjusted by routine experimentation according to the size of a wearer's back, comfort considerations, and desired slip-resistance. A larger surface area of the inner face of support element 12 in contact with the radiation shield garment results in better slip-resistance and, therefore, better support. As shown in FIGS. 1 and 3, rear support element 12 is generally rectangular in shape with outwardly bowed, convex top and bottom edges. This configuration has been found to maximize the surface area of rear support element 12 consistent with user comfort.

Elasticized elements 30 and 32 may be fashioned from any conventional elastic fabric. The length of the elasticized elements (along the axis of the belt) will ordinarily range from about ¼–5 inches, although only enough is needed to impart a small degree of elasticity to the belt to insure that the belt is held snugly in place while in use. If there is some degree of elasticity in other sections of the belt, for example in straps 50 and 52, it may be possible to eliminate one or both elasticized elements consistent with this invention. The width of the elasticized elements (perpendicular to the axis of the belt) will ordinarily be consistent with the end width of elongated rear support element 12 to provide a belt with smooth, continuous top and bottom edges.

Connecting elements 40 and 42 are designed to provide a smooth and comfortable connection between the rear support element 12, including elasticized elements if any, and the adjustable fastening means at the front of the support belt. Because the connecting elements 40, 42 will ordinarily ride on the user's hips while the belt is in use, they should be string, light-weight and comfortable. Although many materials would satisfy these requirements, in the preferred embodiment of this invention, connecting elements 40 and 42 comprise a loosely woven mesh fabric core 44 and 45, respectively, such as textiline, covered with a thin, woven synthetic fabric 46 and 47, respectfully, for example a fabric such as that used to cover the outer face of core 20. The dimensions and shape of connecting elements 40 and 42 should be consistent with the size of other elements of the belt. The rounded, semi-circular ends of elements 40 and 42 contribute to a smooth, finished appearance for the belt. Depending on the dimensions of other elements of the belt, one or both connecting elements can be made smaller or eliminated consistent with this invention. For example, straps 50 and 52 could be directly attached to elasticized elements 30 and 32 respectively thereby eliminating elements 40 and 42.

The adjustable fastening means as shown in FIG. 1 consists of straps 50 and 52 which are attached respectively to connecting elements 40 and 42. Straps 50 and 52 may be fashioned from any strong, light-weight material, such as nylon webbing. At the ends of straps 50 and 52 are mating plastic buckle means 54 and 56 respectively. One or both of said buckle means may include conventional loop and catch means (not shown) for adjusting the length of the adjoining strap. Alternatively, the ends of straps 50 and 52 may include loop fasteners to provide adjustable fastening means.

Figure 2:
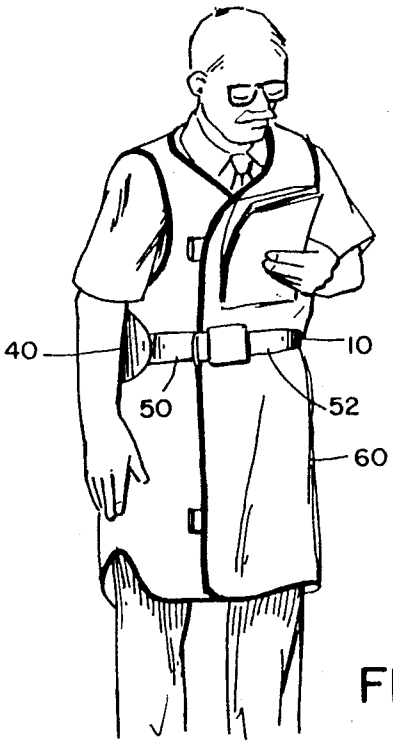
FIG. 2 is a schematic front view of an individual wearing a radiation shield garment and the support belt of this invention.

FIGS. 2 and 3 show the support belt 10 of this invention in use supporting a radiation shield garment 60. The front view in FIG. 2 shows straps 50 and 52 and the buckle means in the fastened position. The rear view in FIG. 3 shows rear support element 12, including covering 28 of the outer face of the core 20, snugly centered around the user's back at waist level in order to support and shift the weight of the radiation shield garment. Foam-layer outer face 24 functionally engages radiation shield garment 60 and inhibits the garment from sliding after belt 10 has been tightened. Support element 12 gives support and comfort to the lumbar area of the user.

It should be understood that the foregoing description of the invention is intended merely to be illustrative and that the other embodiments and modifications may be apparent to those skilled in the art without departing from its spirit.

Having described the invention, what I claim is:

1. A support belt for a radiation shield garment having two free ends comprising in combination a padded, slip-resistant rear support element, a connecting element, and adjustable fastening means for securing the free ends of said belt to one another, wherein said rear support element comprises an elongated flexible core having two ends and an inner core face and an outer core face, said inner core face is covered with a slip-resistant material that frictionally engages the exterior surface of the radiation shield garment.

2. The support belt of claim 1 wherein said flexible core is made of foam.

3. The support belt of claim 1 wherein said slip-resistant material is a foam-backed vinyl, the foam backing facing outwardly.

4. The support belt of claim 3 wherein said outer core face is covered with synthetic fabric.

5. The support belt of claim 1 wherein at least one end of said flexible core is connected to an elasticized element.

6. The support belt of claim 5 further wherein said elasticized element is also connected to said connecting element.

7. The support belt of claim 6 further wherein said connecting element comprises mesh fabric covered with synthetic fabric.

8. The support belt of claim 6 wherein said connecting element is also connected to said adjustable fastening means.

9. The support belt of claim 8 wherein said adjustable fastening means comprises nylon webbing and plastic buckle means.

10. The support belt of claim 8 wherein said adjustable fastening means comprises nylon webbing with interlocking loop fasteners.

11. In a radiation shield garment and support belt therefor the improvement which comprises an independent support belt free of any attachment means that physically attaches said belt to said garment, said belt comprising in combination a padded, slip-resistant support section, an elasticized section, and adjustable fastening means for securing the ends of the belt to one another.

12. The improvement of claim 11 wherein said support section comprises an elongated flexible core having an inner core face and an outer core face, said inner core face is covered with a slip-resistant material that is configured to frictionally engage the exterior surface of the radiation shield garment.

13. The improvement of claim 12 wherein said flexible core is made of foam.

14. The improvement of claim 12 wherein said slip-resistant material is a foam-backed vinyl, the foam backing facing outwardly so as to frictionally engage a radiation shield garment.

15. Apparatus for protecting an individual working in an environment where exposure to radiation is possible comprising in combination:

(a) a radiation shield garment; and (b) an independent support belt free of any attachment means for physically attaching said belt to said garment, said belt comprising a padded, slip resistant support section, an elasticized section, and adjustable fastening means for securing the ends of the belt to one another, said slip-resistant support section configured to bear against and support said garment at the waist of the individual.

16. The apparatus of claim 15 wherein said support section of said belt comprises at least one exterior face of a material that frictionally engages the exterior surface covering the said garment for supporting said garment at the waist of the individual.

* * * * *